US007172388B2

(12) United States Patent
Synnott

(10) Patent No.: US 7,172,388 B2
(45) Date of Patent: Feb. 6, 2007

(54) MULTI-POINT SEAL

(75) Inventor: Remy Synnott, St. Jean sur Richelieu (CA)

(73) Assignee: Pratt & Whitney Canada Corp., Longueuil (CA)

( * ) Notice: Subject to any disclaimer, the term of this patent is extended or adjusted under 35 U.S.C. 154(b) by 174 days.

(21) Appl. No.: 10/923,681

(22) Filed: Aug. 24, 2004

(65) Prior Publication Data

US 2006/0045746 A1 Mar. 2, 2006

(51) Int. Cl.
*F01D 11/00* (2006.01)
*F01D 9/04* (2006.01)

(52) U.S. Cl. ..... 415/135; 415/139; 415/189; 415/209.2; 415/209.4; 415/210.1; 415/174.2; 277/637; 277/644

(58) Field of Classification Search ..... 415/135–139, 415/174.2, 189, 190, 209.2, 209.3, 209.4, 415/210.1; 277/637, 641, 644, 647
See application file for complete search history.

(56) References Cited

U.S. PATENT DOCUMENTS 3,142,475 A * 7/1964 Bobo et al. ..... 415/139
4,384,822 A 5/1983 Schweikl et al.
4,749,333 A 6/1988 Bonner et al.
5,149,250 A 9/1992 Plemmons et al.
5,192,185 A 3/1993 Leonard
5,249,920 A * 10/1993 Shepherd et al. ..... 415/135
5,738,490 A * 4/1998 Pizzi ..... 415/139
5,797,723 A 8/1998 Frost et al.
5,839,878 A * 11/1998 Maier ..... 415/209.2
6,076,835 A 6/2000 Ress et al.
6,164,656 A 12/2000 Frost
6,332,617 B1 12/2001 Leveaux et al.
6,464,457 B1 10/2002 Morgan et al.
6,612,584 B1 9/2003 Ferouz et al.
6,648,333 B2 11/2003 Aksit et al.

* cited by examiner

*Primary Examiner*—Christopher Verdier
(74) *Attorney, Agent, or Firm*—Ogilvy Renault

(57) ABSTRACT

A spring seal for sealing a gap defined between first and second gas turbine engine components. The spring seal has a grasping portion for graspingly receiving a portion of the first component, and a spring loading portion adapted to extend between the first and second gas turbine engine components for spring loading the first and second gas turbine engine components relative to one another.

17 Claims, 3 Drawing Sheets

MULTI-POINT SEAL

TECHNICAL FIELD

The invention relates generally to gas turbine engines and, more particularly, to an improved sealing arrangement.

BACKGROUND OF THE ART

Over the years various types of seals have been designed to prevent air leakage between gas turbine engine components. For instance, W-shaped seals and leaf seals have been used to seal the joint between gas turbine engine vane ring segments and the associated inner and outer supporting structure.

Even with the variety of earlier designs, there remains a need for a combined spring and seal arrangement which is efficient, easy to install and adapted to accommodate thermal growth differential between the engine components to be sealed and spring loaded.

SUMMARY OF THE INVENTION

It is therefore an object of this invention to provide an improved spring seal arrangement suited for use in a gas turbine engine.

In one aspect, the present invention provides a spring seal for sealing a gap defined between first and second gas turbine engine components, the spring seal having a grasping portion defining a mouth adapted to graspingly receive a portion of said first component, and a spring loading portion adapted to extend between said first and second gas turbine engine components for spring loading the first and second gas turbine engine components relative to one another, said spring loading portion and said grasping portion having opposed component engaging surfaces adapted to be fitted in sealing engagement against opposed surfaces of the second component in a direction substantially normal to a spring loading direction of said spring loading portion.

In another aspect, the present invention provides a vane mounting arrangement comprising a vane ring including a number of vane ring segments received at a radial inner end portion thereof between forward and aft radially outwardly extending flanges of an inner ring, and a spring seal having a vane ring grasping portion including first and second legs clampingly engaged with said radial inner end portion of each of said vane ring segments, and an axial spring loading portion extending between the vane ring segments and said inner ring.

In another aspect, the present invention provides a vane mounting arrangement comprising an inner support defining a radially outwardly facing groove, a spring seal held in said groove against radially opposed inner and outer surfaces, and circumferentially adjoining vane ring segments mounted in said radially outwardly facing groove, wherein each segment has a radially inwardly projecting leg graspingly received in a mouth defined by said spring seal, and wherein said vane ring segments are axially spring loaded relative to said inner ring by said spring seal Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
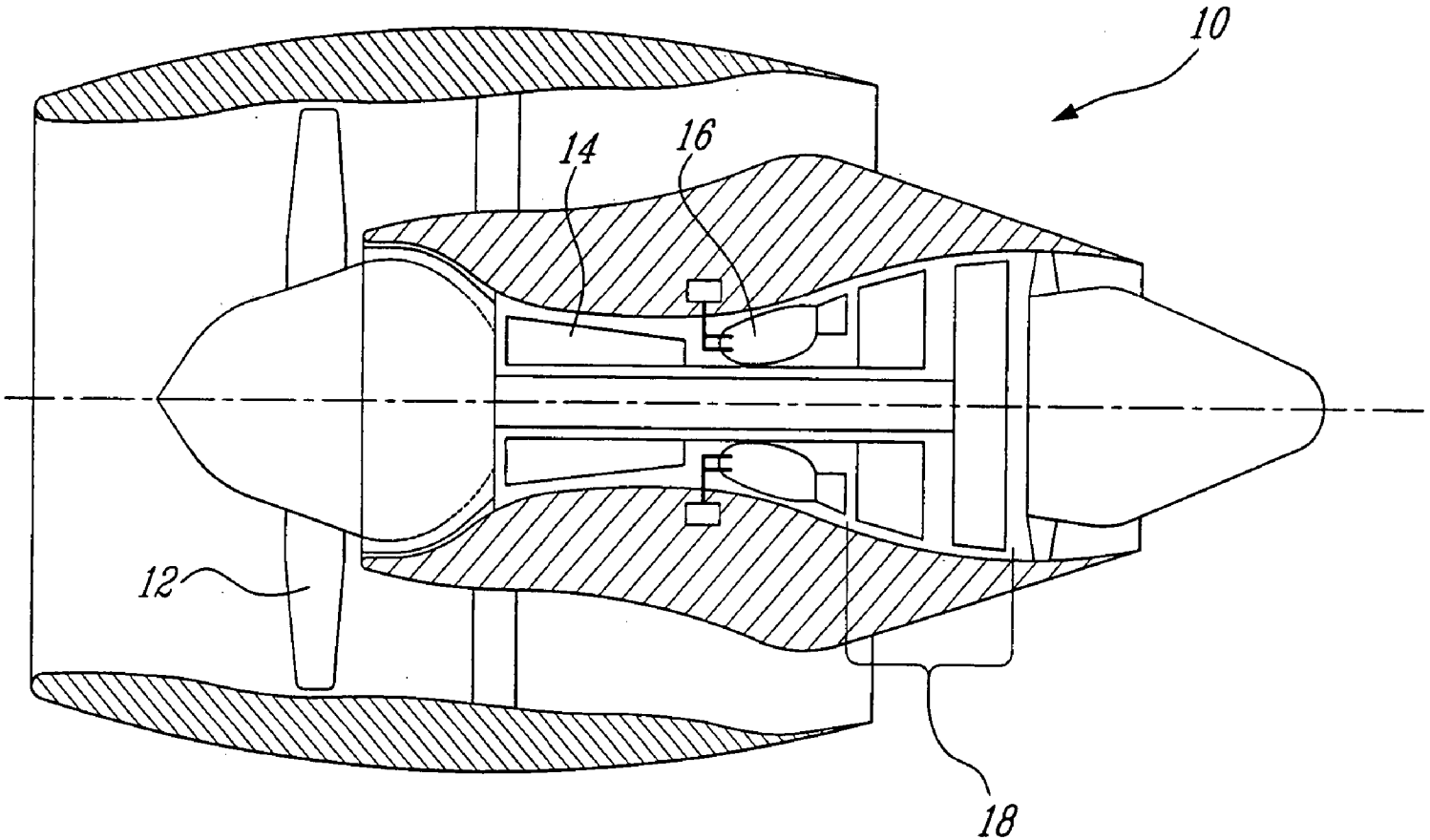
FIG. 1 is a schematic, longitudinal sectional view of a turbofan gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
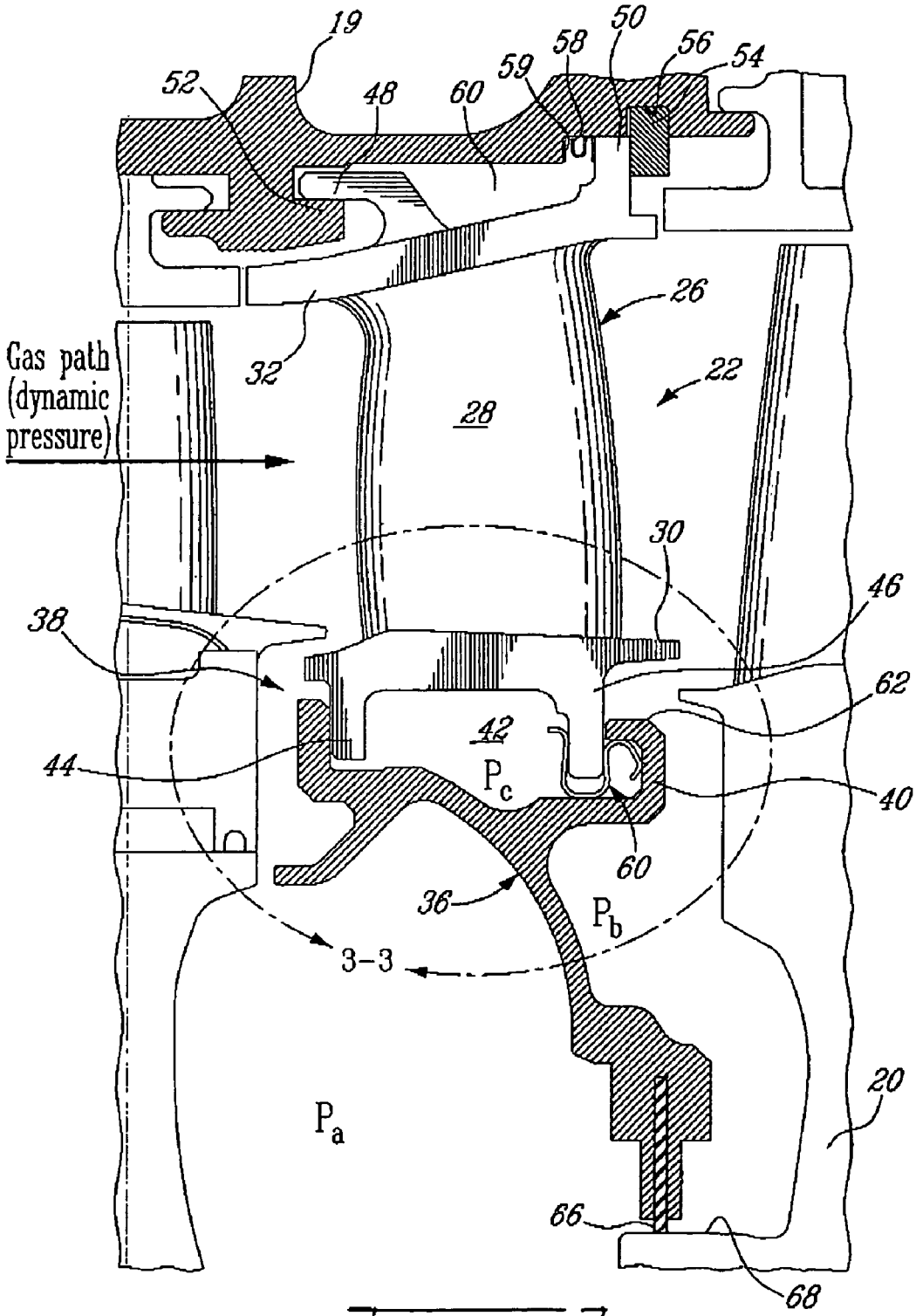
FIG. 2 is a side view of a vane ring mounting arrangement of the engine shown in FIG. 1 in accordance with an embodiment of the present invention.

As shown in FIG. 2, the gas turbine section 18 has one or more stages disposed within an outer casing, such as a turbine support case 19. Each turbine stage commonly comprises a turbine rotor 20 that rotates about a centerline axis of the engine 10 and a stationary vane ring 22 for channelling the combustion gases to the turbine rotor 20. The vane ring 22 is commonly segmented around the circumference thereof with each vane ring segment 26 having a plurality of circumferentially spaced-apart turbine vanes 28 (only one of which is shown in FIG. 2) extending radially between inner and outer arcuate bands 30 and 32 that define the radial flow path boundaries for the hot combustion gases flowing through the vane ring 22.

The vane ring segments 26 are pre-assembled onto a preferably a circumferentially one-piece inner ring 36 prior to being mounted into the turbine support case 19. The use of a one-piece inner ring is preferred to facilitate the vane assembly procedure while providing for a simpler, lighter and cheaper vane mounting arrangement as compared to conventional bolted multi-pieces inner supports. In the past, multi-pieces inner supports have been required because the vane segments were first secured to the outer intermediate ring and then bolted or otherwise attached to the inner support.

As shown in FIG. 2, the one-piece inner ring 36 is integrally provided with axially spaced-apart radially outwardly extending flanges 38 and 40 defining therebetween a radially outwardly facing annular groove or cavity 42 for receiving the circumferentially adjoining vane ring segments 26. The inner band 30 of each vane ring segment 26 is provided with integral forward and aft radially inwardly extending legs 44 and 46 adapted to be received in cavity 42 between the axially spaced-apart annular flanges 38 and 40.

As will be seen hereinafter, the turbine support case 19 and the outer band 32 of the vane ring segments 26 have a mounting interface which is specifically designed to permit the vane ring segments 26 and the one-piece inner ring 36 to be pre-assembled and then mounted as a single unit directly to the case 19. For that purpose, the outer band 32 is integrally provided with a forward retention hook 48 and an aft radially outwardly extending reaction leg 50. The forward retention hook 48 is adapted to be axially slid in engagement with a corresponding forward annular support flange 52 integrally formed on the inner surface of the annular turbine support case 19. The support flange 52 is spaced radially inwardly from the inner surface of the case 19 to form therewith an annular groove in which is axially received the forward retention hook 48 of the outer band 32.

The forward retention hook 48 and the support flange 52 thus provide an axial tongue and groove arrangement which radially support the forward end of the vane ring segments 26.

According to the illustrated embodiment, the aft reaction leg 50 has no intrinsic axial connection to case 19 and only abuts against the inner surface of the case 19 in a radially outward direction. This provides a non-secured fixing or floating connection at the aft end of the vane ring 22. There is thus no special action required to fix the aft leg 50. This mounting arrangement rather relies on the dynamic gas pressure of the combustion gases flowing between the inner and outer bands 30 and 32 to secure the vane ring 22 in place. In use, the aft leg 50 is pushed radially outwardly against the case 19 as the gas path dynamic pressure tends to rotate the vanes 28 about the hook point formed by the forward retention hook 48 and the forward flange 52.

After the forward retention hook 48 has been axially slid in engagement with the forward flange 52 of the case 19, an annular retainer 54 is mounted in a radially inwardly facing slot 56 defined in the case 19 to form an axial aft stop against which the aft leg 50 can abut to retain the vane ring 22 against axially aft movement during engine operation. A W-shaped annular spring seal 58 extends between a radially inwardly extending shoulder 59 defined in the inner surface of the case 19 and a front face of the aft reaction leg 50. The W-seal 58 seals the air cooling cavity (not indicated) defined between the outer band 32 and the case 19 and urges the aft reaction leg 50 against the axial retainer 54 to help maintain aft reaction leg 50 generally abutting case 19 while the engine is not in operation (i.e. when there is no dynamic gas pressure exerted on the vane ring 22).

Figure 3:
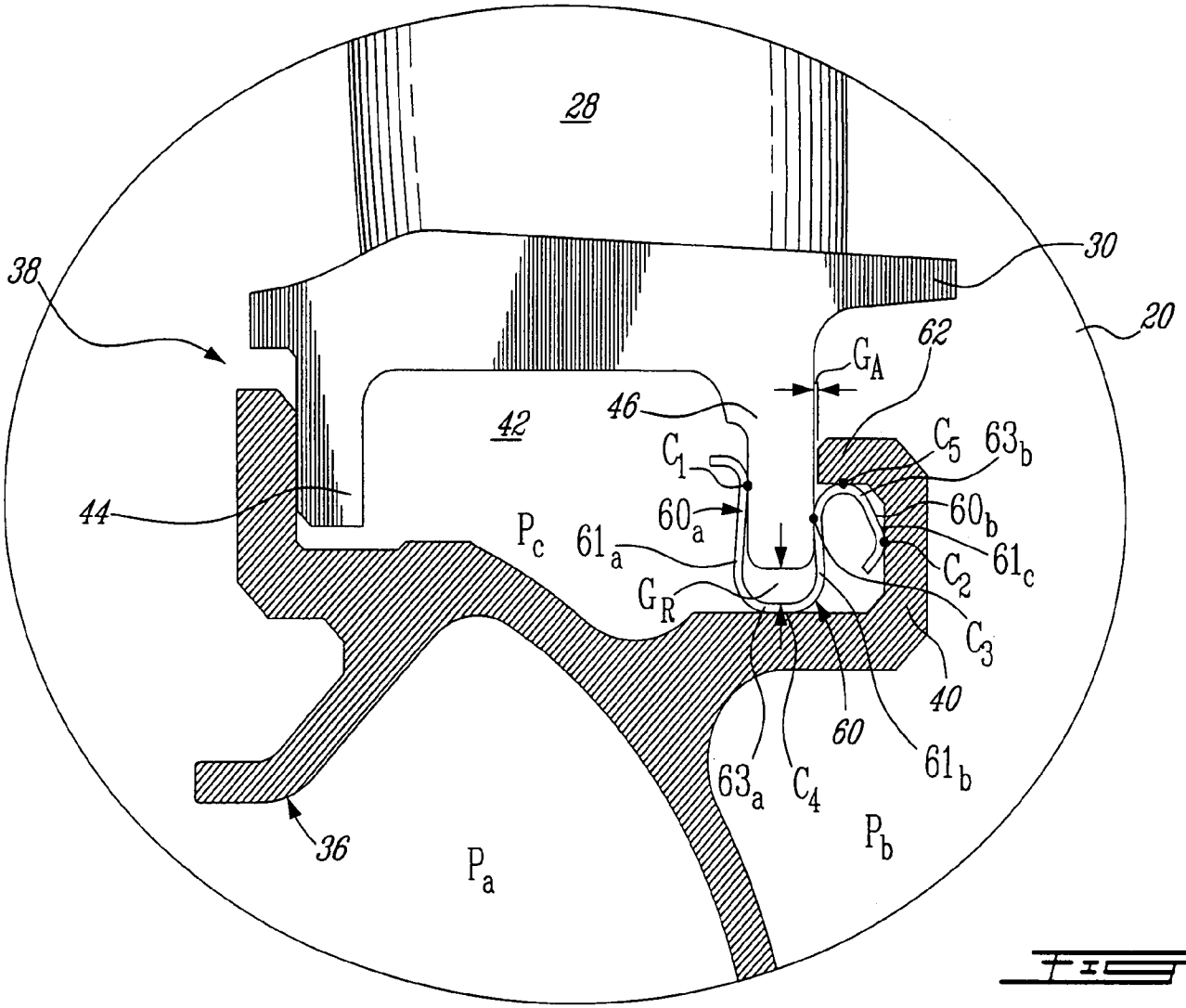
FIG. 3 is an enlarged side view of a radial inner portion of the vane ring mounting arrangement shown in FIG. 2.

An annular S-shaped spring seal 60 is installed in the annular cavity 42 of the inner ring 36 over the aft leg 46 of the inner band 30 to seal cavity 42 and provide a forward spring force to keep the vane ring 22 in place when the engine 10 is shut down (i.e. when there is no dynamic gas pressure exerted on the vane ring 22). As shown in FIG. 3, the S-shaped spring seal 60 has a forward U-shaped clamping portion 60*a* defining a radially outwardly open mouth for graspingly receiving aft leg 46. The forward clamping portion 60*a* has first and second clamping legs 61*a* and 61*b* connected by a first bow portion 63*a*. The second leg 61*b* of spring seal 60 is connected to a third leg 61*c* via a second bow portion 63*b* and formed therewith a spring loading portion 60*b*. The second bow portion 63*b* and the third leg 61*c* are lodged under an annular rim 62 extending axially forward from the rear radially outwardly extending flange 40 of the inner ring 36. The spring loading portion 60*b* pushes against the aft flange 40 of the inner ring 36, thereby biasing the front surface of the forward leg 44 into engagement with flange 38 to prevent air leakage therebetween at all conditions. In hot running condition, $P_a>P_b$ and $P_c>P_a$. By spring loading the vane ring 22 forward, the contact interface is maintained between the leg 44 and the flange 38 and since $P_c>P_a$, this contact interface can be used for sealing.

The S-shaped seal 60 has two axial contact points $C_1$ and $C_2$ with leg 46 and one axial contact point $C_3$ with flange 40. S-seal 60 also has two radial contact points $C_4$ and $C_5$ with the inner ring 36, one against the bottom surface of the cavity 42 and the other one against the undersurface of rim 62. The radial contact points $C_4$ and $C_5$ are used for sealing and fixing the seal 60 in cavity 42. The multiple point of contacts or sealing points provide improved sealing to prevent cooling air leakage from cavity 42 via the radial and axial gaps $G_R$ and $G_A$, which are designed to accommodate the thermal growth differential between vane ring 22 and inner ring 36 during engine operation. S-shaped seal 60 advantageously seals under all running conditions by accommodating thermal expansion.

In addition to its enhanced sealing function, the S-seal 60 provides the required forward spring force to push vane segments 26 forward in order to maintain the forward retention hooks 48 axially engaged with the forward flange 52 when there is no dynamic gas pressure, i.e. when the engine 10 is not running. Spring loading the inner ring 36 backwards also avoids any rubs at the leading edge of the vane ring 22 when the pressure $P_a$ is equal or near equal to $P_b$. Furthermore, it ensures that the brush seal 66 (FIG. 2) carried by the inner ring 36 remains on the hard coating 68 (FIG. 2) of a forward extension of the adjacent bladed rotor 20.

The principle advantages of S-seal 60 are: improved sealing efficiency, low cost and easy to assemble to the inner ring 36 and vane segments 26.

During assembly, the vane segments 26 are first radially inserted into the inner ring 36 between the axially spaced-apart flanges 38 and 40 with the aft radially inwardly extending legs 46 of the segments 26 received in the forward U-shaped grasping portion 60*a* of the S-seal 60. The seal 60 has been previously fitted in radial compression between the rim 62 and the bottom surface of groove 42. Then, the vane segments 26 and the inner ring 36 are axially inserted as a single unit into outer case 19 so as to engage the forward hooks 48 onto the forward flange 52 and abut the front face of the aft reaction legs 50 against W-seal 58. Thereafter, the retainer 54 is radially engaged in groove 56 to prevent backward movement of the vane assembly. In use, the hot combustion gases flowing between inner band 30 and the outer band 32 pushes the reaction leg 50 radially outwardly against the case 19, thereby securing each vane segment 26 in place. As mentioned above, the support ring 36 is preferably one-piece, and therefore preferably seal 60 is circumferentially discontinuous (i.e. includes at lease one radial cut therethrough) to facilitate insertion as mentioned above. Where support 36 is provided in more than one piece, a circumferentially continuous seal 60 is preferably provided.

The above description is meant to be exemplary only, and one skilled in the art will recognize that changes may be made to the embodiments described without department from the scope of the invention disclosed. For example, various types of biasing members could be used to spring load the vane segments 26 relative to the inner ring 36 and to urge the aft leg 50 against the axial retainer 54. Also, the inner ring 36 does not necessarily have to be of unitary construction. The aft leg 50 could have various configuration has long as it does not require any special action to secure it in place. For instance, it could have an axial component. Still other modifications which fall within the scope of the present invention will be apparent to those skilled in the art, in light of a review of this disclosure, and such modifications are intended to fall within the appended claims.

The invention claimed is:

1. A spring seal for sealing a gap defined between first and second gas turbine engine components, the spring seal having a grasping portion defining a mouth graspingly engaging opposed sides of said first component, and a spring loading portion extending between said first and second gas turbine engine components for spring loading the first and second gas turbine engine components relative to one another along a first direction, said spring loading portion and said grasping portion having opposed component engaging surfaces fitted in sealing engagement against opposed surfaces of the second component in a second direction substantially normal to the first direction.

2. The spring seal as defined in claim 1, wherein the spring seal is S-shaped.

3. The spring seal as defined in claim 1, wherein said grasping portion comprises first and second clamping legs defining therebetween said mouth, said first and second clamping legs clampingly engaging the opposed sides of said first gas turbine engine component.

4. The spring seal as defined in claim 3, wherein said first and second legs are resiliently connected by a bow portion having an outer surface forming part of said component engaging surfaces to bear against a corresponding surface of said second gas turbine engine component.

5. The spring seal as defined in claim 3, wherein said second leg has a first end connected to said first leg, the second leg having a second opposite end connected to a third leg, said third leg being spring load relative to said second leg and pushing against the second gas turbine engine component.

6. The spring seal as defined in claim 5, wherein said third leg is connected to said second leg via a bow portion, said bow portion having an outer surface adapted to being against a corresponding surface of said second gas turbine engine component and forming part of said component engaging surfaces.

7. The spring seal as defined in claim 5, wherein said first leg is connected to said second leg via a first bow portion, said third leg being connected to said second leg via a second bow portion opposite said first bow portion, and wherein said component engaging surfaces are provided on respective outer sides of said first and second bow positions for sealing engagement with opposed surfaces of said second gas turbine engine component.

8. A vane mounting arrangement comprising a vane ring including a number of vane ring segments having a radial inner end portion received between forward and aft radially outwardly extending flanges of an inner ring, and a spring seal having a vane ring grasping portion including first and second legs clamping onto said radial inner end portion of each of said vane ring segments, and an axial spring loading portion extending between the vane ring segments and said inner ring.

9. The vane mounting arrangement as defined in claim 8, wherein said first and second legs are connected to each other by a first bow portion, said first bow portion cooperating with said first and second legs to define a radially outwardly facing mouth, and wherein said first bow portion has a first radial point of contact with said inner ring.

10. The vane mounting arrangement as defined in claim 9, wherein said axial spring loading portion comprises a third leg connected to said second leg by a second bow portion opposite said first bow portion, said second bow portion having a second radial point of contact with said inner ring.

11. The vane mounting arrangement as defined in claim 10, wherein said second bow portion is spring loaded against an undersurface of a rim extending axially forwardly from the aft flange of the inner ring.

12. The vane mounting arrangement as defined in claim 8, wherein each of said vane ring segments comprises an aft leg extending radially inwardly from an inner band, and wherein said first and second legs of said spring seal are axially engaged with forward and aft facing sides of said aft leg, and wherein said spring loading portion extends axially between said aft facing side of said leg and said aft flange to exert an axial pushing action against said aft flange.

13. The vane mounting arrangement as defined in claim 8, wherein said spring seal is S-shaped.

14. The vane mounting arrangement as defined in claim 9, wherein there is an axial gap between the radial inner portion of the vane ring segments and the aft flange, and wherein there is a radial gap between the radial inner end portion and said first bow portion.

15. A vane mounting arrangement comprising an inner support defining a radially outwardly facing groove, a spring seal held in said groove against radially opposed inner and outer surfaces, and circumferentially adjoining vane ring segments mounted in said radially outwardly facing groove, wherein each segment has a radially inwardly projecting leg graspingly received in a mouth defined by said spring seal, and wherein said vane ring segments are axially spring loaded relative to said inner ring by said spring seal, wherein the spring seal comprises first, second and third axially spaced-apart legs, said first and second legs being respectively in clamping engagement with forward and aft facing sides of the radially inwardly projecting leg of the vane ring segments, whereas said third leg has an axial contact point with an end wall of said groove.

16. The vane mounting arrangement defined in claim 15, wherein the first and second clamping legs have respective radial inner end interconnected by a first bow portion, and wherein said second leg has a radial outer end connected to the third leg by a second bow portion opposite said first bow portion, said first and second bow portions being respectively in radial engagement with radially outer and radially inner facing surfaces said inner support.

17. The vane mounting arrangement as defined in claim 15, wherein the spring seal is S-shaped.

* * * * *

UNITED STATES PATENT AND TRADEMARK OFFICE

CERTIFICATE OF CORRECTION

PATENT NO. : 7,172,388 B2
APPLICATION NO. : 10/923681
DATED : February 6, 2007
INVENTOR(S) : Remy Synnott It is certified that error appears in the above-identified patent and that said Letters Patent is hereby corrected as shown below:

claim 6, column 5, line 23, delete “being” and insert --bear--

Signed and Sealed this

First Day of May, 2007

JON W. DUDAS
*Director of the United States Patent and Trademark Office*